United States Patent [19]

Brown

[11] 4,245,676

[45] Jan. 20, 1981

[54] START MARK PREVENTER FOR LOOMS

[75] Inventor: Ralph H. Brown, Kernersville, N.C.

[73] Assignee: Rockwell International Corporation, Pittsburgh, Pa.

[21] Appl. No.: 92,591

[22] Filed: Nov. 8, 1979

[51] Int. Cl.[3] ..... D03D 49/20

[52] U.S. Cl. ..... 139/316

[58] Field of Search ..... 139/291 R, 304, 316, 139/328, 113

[56] References Cited

U.S. PATENT DOCUMENTS

| | | | |
|---|---|---|---|
| 889,237 | 6/1908 | Jenckes et al. | 139/316 |
| 913,969 | 3/1909 | O'Sullivan | 139/316 |
| 1,695,385 | 12/1928 | Payne | 139/316 |
| 2,956,588 | 10/1960 | Pfarrwaller | 139/316 |
| 3,165,125 | 1/1965 | Tinkham | 139/291 R |

FOREIGN PATENT DOCUMENTS

| | | | |
|---|---|---|---|
| 5921 | of 1906 | United Kingdom | 139/316 |

*Primary Examiner*—Henry Jaudon

[57] ABSTRACT

An improved start mark preventer for looms formed by a manually operable device including a double armed lever having a control handle mounted on one arm and a control pawl on the other arm. The control pawl is disposed in operative engagement with the loom's ratchet wheel which rotates its take-up roll by means of a feed pawl and hold-back pawl. The device includes a guide for the control handle with selectively positionable stop members that provide a neutral, first and second positions for the handle. Movement of the handle to the first position moves the fell forwardly of the reed's beat-up position, in the second position the fell is permitted to return to its initial position and upon starting the loom the control handle will automatically move to its neutral position.

6 Claims, 5 Drawing Figures

FIG. 1
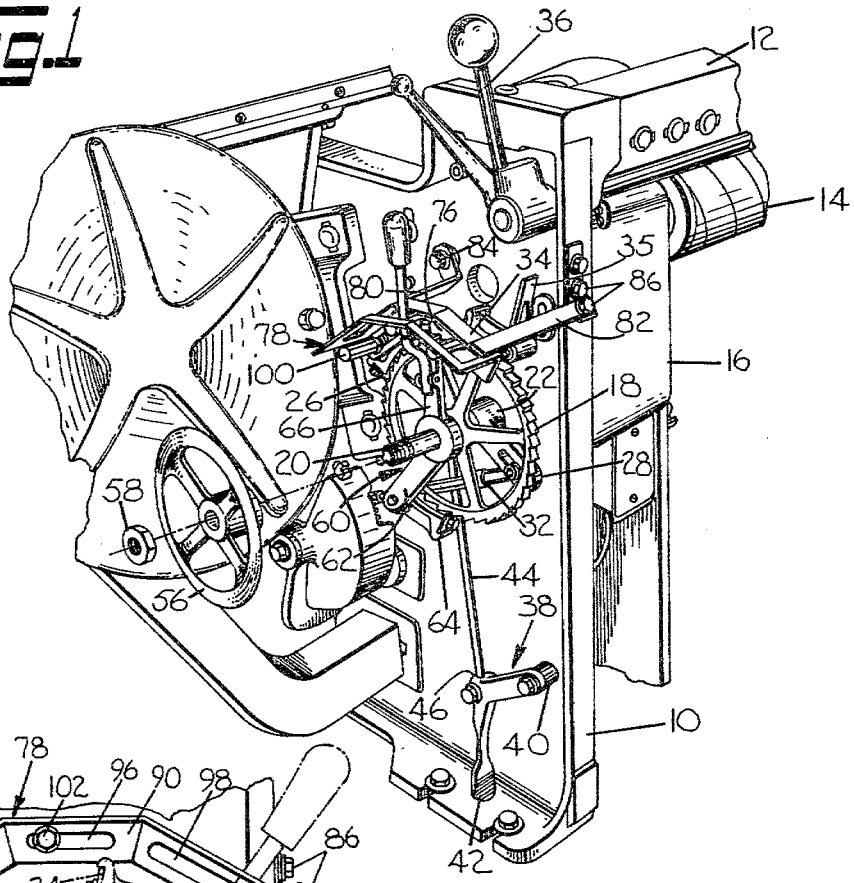
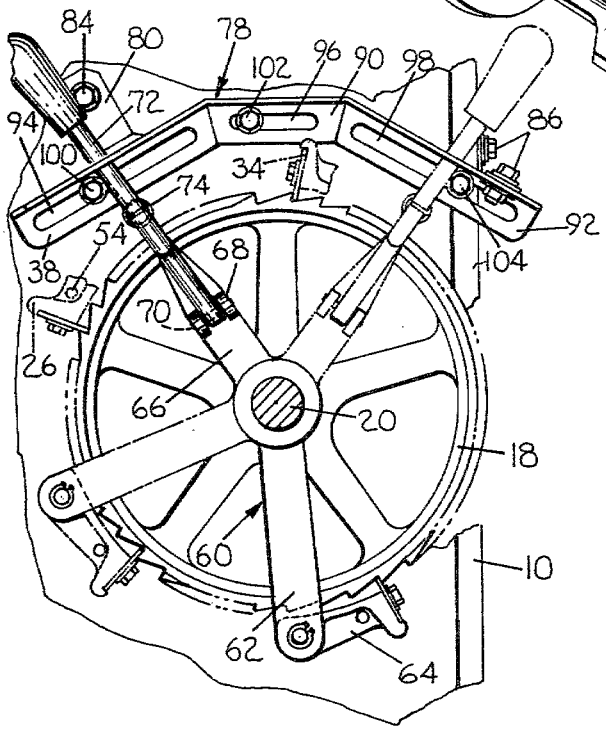
FIG. 2
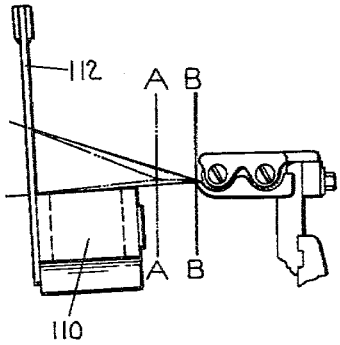
FIG. 3

36
10
72
102
96
90
35
98
84
80
100
94
74
50
34
86
92
104
78
88
54
26
48
70
66
24
52
18
28
30
60
62
64
32
44

START MARK PREVENTER FOR LOOMS

BACKGROUND OF THE INVENTION

1. Field of Invention

The invention pertains to looms wherein fabric as it is formed is incrementally advanced by a take-up roll that is rotated by the combination of a ratchet wheel operatively associated with one end thereof and so-called feed and hold-back pawls which are mounted so as to engage the teeth of said ratchet wheel.

2. Description of the Prior Art

In looms for weaving it is customary to provide a knockoff means which serves to initiate stopping of the looms preferably by disconnecting the source of power and applying a brake to accelerate the stopping function. Such mechanism is normally dependent upon or functions in accordance with indications taken from a weft feeling or sensing mechanism, such as in and of itself, well known to those conversant in the weaving art.

When a loom stops as a result of weft breakage, the loom is turned over to that shed opening containing the broken weft, and during this turning over of the loom, the reed is caused to strike the fell line of the fabric. The reed's striking of the fell during this turning over of the loom has a tendency to pack the preceeding length of weft more tightly than those which form the fabric immediately adjacent thereto or which precede said length of weft. This additional beat-up or packing of the weft also has a tendency to stretch slightly the warp threads at this point and together form a distinct line or, in other words, a starting mark when the loom is started in order to resume weaving.

A number of prior art patents disclose devices for preventing start marks in fabric and for a more detailed description of these devices, attention is directed to U.S. Pat. Nos. 3,165,125 and 3,891,010.

When a loom stops as a result of a weft break, the start mark preventer of the present invention is adapted to be pre-set so that the fell can be moved forwardly of the reed beat-up position a pre-selected distance to meet the requirements of a particular type of fabric when the loom is turned over to the shed opening containing the broken pick. After removal of the broken pick of weft, the device is again actuated and the fell is caused to return to the precise position whereat weaving can be resumed without creating a start mark in the fabric.

SUMMARY OF THE INVENTION

The improved start mark preventer according to the present invention defines a manually operable control device having a control handle for a control pawl that is disposed in operative engagement with the loom's ratchet wheel which, as is well known, is effective by means of conventional feed and hold-back pawls of advancing the fabric as it is formed. The control handle is selectively movable within the limits of a guide bracket that is provided with selectively positionable pin members that define a neutral, first and second position for said control handle. The pin members are selectively positionable which permits the control handle to be moved to those positions which are best suited for the particular fabric being woven.

The control handle is in the neutral position during loom operation and when stopped by a weft break, it is manually pushed to its first position which is effective in rotating the take-up roll in a direction to move the fell forwardly of the reed's beat-up position. When the handle is moved to its second position, the fell is permitted to return to the position proper for the next pick and upon starting the loom, said handle will automatically move to its neutral position.

It is a general object of the invention to provide a means for preventing starting marks in fabric upon starting up a loom after a weft break.

It is a further object of the invention to move the fabric and its fell line forwardly of the reed's beat-up position when turning a loom over the shed opening containing the broken pick of weft.

A more specific object of the invention is to provide a mechanism which is effective in moving the fabric and its fell line forwardly of the reed's beat-up position and for returning the same to a position proper for the insertion of the next pick without disturbing the take-up or let-off settings of the loom.

These and other objects of the invention will become more fully apparent by reference to the appended claims and as the following detailed description proceeds in reference to the figures of drawing wherein:

BRIEF DESCRIPTION OF THE DRAWINGS

FIG. 1 is a perspective view of a portion of a loom showing the device according to the invention applied thereto;

FIG. 2 is a view in side elevation of the device shown in FIG. 1 showing the invention's control handle in its first and second positions;

FIG. 3 is a view in side elevation of a loom's reed, lay beam and temple showing by means of phantom lines the fell of the fabric in its normal position and by solid lines the position to which it is moved forwardly of the reed's beat-up position;

DESCRIPTION OF THE PREFERRED EMBODIMENT

Now referring to the figures of drawing, enough of a loom is shown in FIG. 1 to serve as a basis for a detailed description of the invention applied thereto.

Figure 5:
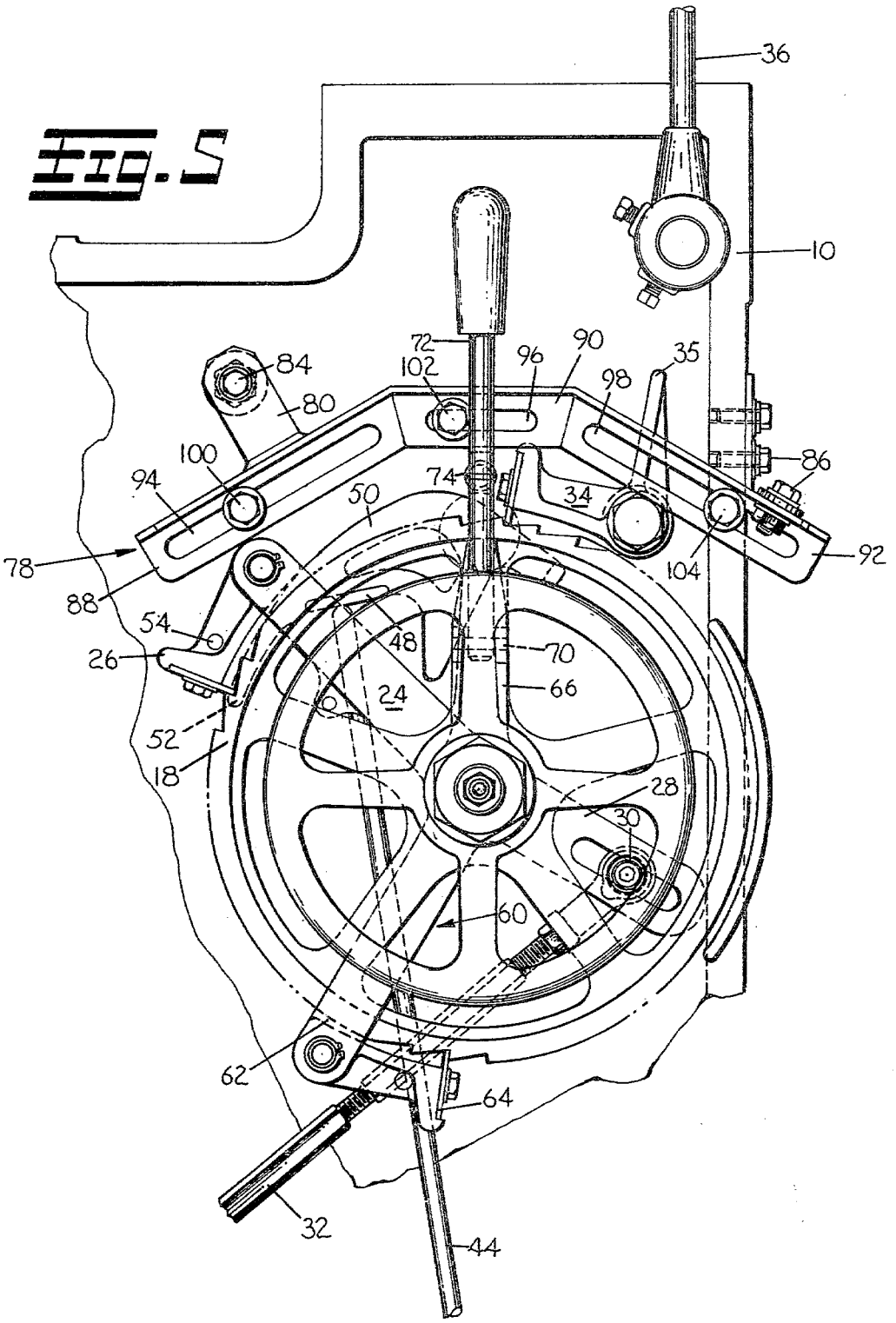
FIG. 5 is a view similar to FIG. 2 but showing the control handle in its neutral or loom operating position.

In FIG. 1 the forward left hand side of a shuttleless loom is shown and among the various parts thereof there is shown a portion of the left hand loomside at 10 and breast beam at 12. The loom's fabric take-up roll is identified by numeral 14 and is rotated in a well known manner by gearing contained within a housing 16 that is operatively connected to the loom's take-up ratchet wheel 18 by means of a shaft 20. This shaft 20 is horizontally disposed and extends from the housing 16 outwardly through an opening (not shown) in the loomside 10 and has the ratchet wheel 19 fixed thereon in slightly spaced relation to said loomside. Intermediate the ratchet wheel 18 and the loomside 10 the shaft 20 has a double armed lever 22 (FIG. 1) pivotably mounted thereon. A first arm 24 of the double armed lever 12 extends in a generally upwardly direction and has a feed pawl 26 pivotably mounted on the end thereof so as to operatively engage the teeth of the ratchet wheel 18. The second arm of this double armed lever 22 is identified by numeral 28 and extends in a generally downward direction and is attached at 30 to a link 32 which is connected to a well known source of drive for effecting periodic actuation of the feed pawl 26 and rotation of the ratchet wheel 18. A conventional form of hold back pawl 34 functions in a known manner to maintain the ratchet wheel in each position to which it is advanced by the feed pawl 26. As shown in FIGS. 1 and 5, this hold back pawl 34 is pivotably mounted on the loomside 10 so as to engage the teeth of the ratchet wheel 19 forwardly of the position of the feed pawl 26 and includes an integrally formed ear 35 which extends in the direction of the loom's shipper handle 36.

Referring again to FIGS. 1 and 5, the loom is provided with a conventional foot actuated feed pawl release mechanism which includes a lever generally indicated by numeral 38 pivotably attached to the loomside 10 as at 40. The lower end of this lever defines a foot pedal 42 and one end of an upwardly extending actuating rod 44 is pivotably attached to said lever as at 46. The upper end of the actuating rod 44 is in engagement with the underside of a lip element 48 (FIG. 5) which extends laterally from an arcuated pawl release finger 50 which is pivotably mounted on the loomside by any suitable means not shown. The free end of this finger 50 is identified by numeral 52 and extends to a position which locates it beneath a laterally extending pin 54 carried by the feed pawl 26. By pressing on the foot pedal 42 it will pivot in a clockwise direction as viewed in FIG. 1 causing the actuating rod 44 to move in an upwardly direction. This movement will pivot the release finger 50 upwardly causing its free end 52 to engage the pin 54 and lift the feed pawl 26 out of engagement with the teeth of the ratchet wheel 18.

A conventional handwheel 56 is fixed on the outer end of the shaft 20 by means of a nut 58 and provides a well known means for manual manipulation of the take-up mechanism.

Figure 4:
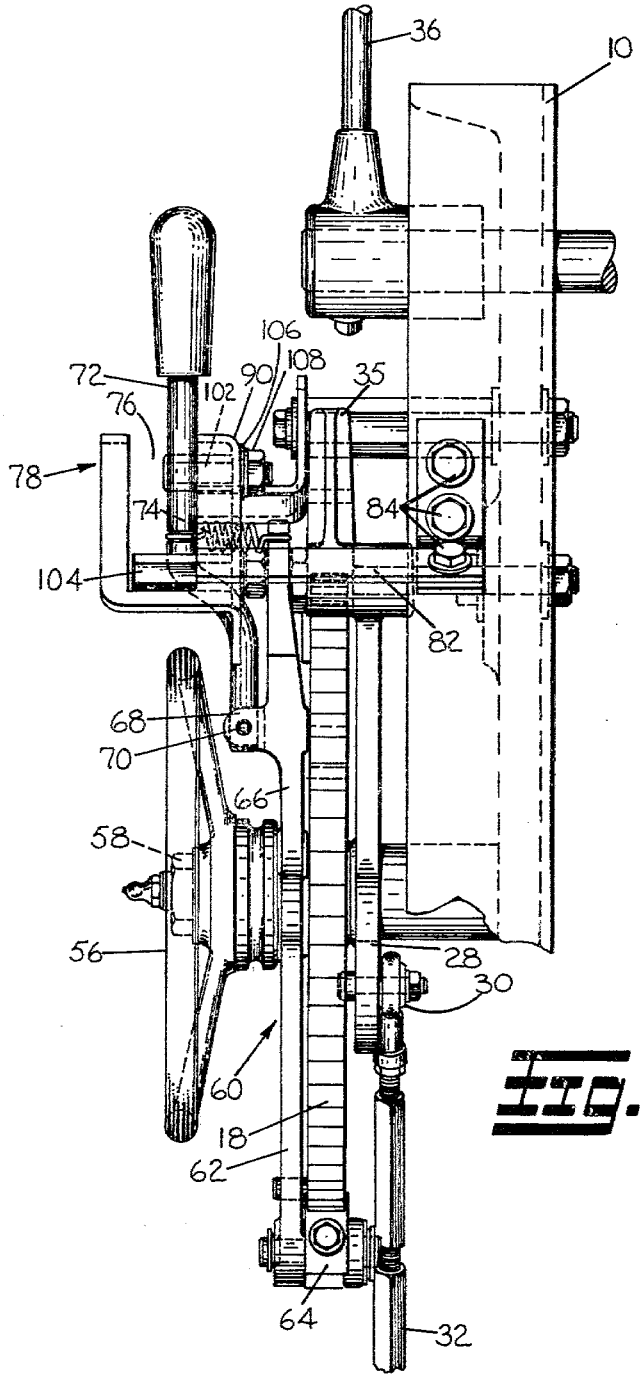
FIG. 4 is a view in front elevation showing additional detail of the device in FIGS. 1 and 2.

The mechanism according to the invention includes among its various parts a bell crank lever that is identified generally by numeral 60 and which is pivotably mounted on shaft 20 intermediate the ratchet wheel 18 and the hand wheel 56. A first arm 62 of this bell crank lever 60 extends in a generally downwardly direction and has a control pawl 64 pivotably mounted on the lower end thereof which extends into operative engagement with the teeth of the ratchet wheel 18. The second arm of the bell crank lever 60 is depicted by numeral 66 and is provided intermediate its ends with a pair of integrally formed and spaced bosses 68. Each of the bosses 68 is provided with a hole which is in alignment one with the other and by means of a pin 70 assembled therein the lower end of a control handle 72 is pivotably supported between said bosses. As shown in FIG. 4, the control handle 72 is spring biased in the direction of the loomside 10 by means of a coil spring 74 which interconnects said control handle with the upper end of the second arm 66 of the bell crank lever 60.

The control handle 72 extends upwardly through an elongated opening 76 provided in a bracket member generally indicated by numeral 78 which is supported above the bell crank lever 60 by means of extensions 80 and 82 which attach to the loomside 10 by means of bolts 84 and 86 respectively. This bracket member is formed by three segments 88, 90 and 92 that are joined end to end and have a cross sectional configuration that is generally L shaped with one leg of each segment extending in a downwardly direction. As shown in FIGS. 2 and 5 the center segment 90 is horizontally disposed and the segments 88 and 92 forming the ends of the bracket member are inclined downwardly from the ends of said center segment. The elongated opening 76 is formed by the combination of the three segments 88, 90 and defines a track within which the control handle is selectively movable. The downwardly extending leg of each of the segments 88, 90 and 92 is provided with an elongated slot and respectively they are identified by numerals 94, 96 and 98 (FIGS. 2 and 5). Each of the elongated slots 94, 96 and 98 have a selectively positionable pin member assembled therein which are depicted by numerals 100, 102 and 104 respectively. The portion of each pin which passes through its respective elongated slot is of reduced size and threaded and as shown in FIG. 4 they are provided with a washer 106 and nut 108 for maintaining them in their selected positions.

Pin member 102 is of shorter length than pin members 100 and 104 and being assembled in the elongated slot of segment 90, it defines the control handle's neutral position or that position where it is located during actual loom operation. Pin member 100 defines the control handle's first position which when selectively moved to that position is effective in advancing the fell of the fabric from that position depicted by line A—A to line B—B in FIG. 3.

In FIG. 3 the loom's lay beam is shown at 110 and the reed carried thereby is depicted by numeral 112. Selective movement of the fell to the position of line B—B in FIG. 3 locates it forwardly of said reed's beat-up position so as to prevent its contact with said fell when turning a loom over to a shed opening containing a broken pick of weft.

Pin member 104 defines the control handle's second position which when moved thereto permits the fell to return to the proper position for receiving the next pick when starting the loom. As with pin member 100, the position of the pin member 104 is pre-selected for a particular type of fabric being woven and its selected location is determined so that the amount the loom was turned over to repair a broken pick is compensated for when determining the distance the fell must move to return to the proper position for receiving the next pick.

To summarize the operation, an operator upon stoppage of a loom as a result of a weft break, pivots the control handle 72 to the left so as to clear the end of the pin member 102 and then pushes said handle to its first position where it is in contact with pin member 100. This movement causes the control pawl 64 to rotate the ratchet wheel 18 and through its operative connection with the cloth roll 14, the fabric and fell line thereof are advanced so as to position said fell line forwardly and clear of the beat-up position of the loom's reed 112. The loom is then turned over in the usual manner to the shed opening containing the broken pick. After repairing the broken pick the operator actuates the foot pedal 42 to effect release of the feed pawl from engagement with the teeth of the ratchet wheel 18. At the same time the foot pedal is actuated the operator with one hand releases the hold-back panel 34 by pulling forwardly on the ear 35 thereof and with the other hand pulls the control handle 72 to its second position where it is in engagement with pin member 104. This movement permits the fabric and fell to move rearwardly by means of the tension placed thereon when it was moved forwardly by the control pawl 64 and the pre-selected position of the pin member 104 compensates for the amount the loom was turned over to repair the broken pick so that the fell moves rearwardly to the precise position for the next pick.

The loom is then started and as the pick wheel is rotated by the pawl elements of the take-up mechanism, the control handle 72 advances to its neutral or loom operating position.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. In combination with a loom having a lay beam and reed and a take-up roll to advance fabric as it is formed with means for rotating the take-up roll including a shaft operatively connected thereto, a ratchet fixed on the shaft having an actuating lever with a feed pawl engagable with the ratchet and a hold-back pawl for maintaining the positions of the roll advanced by the feed pawl, an improved start mark preventer comprising:

(a) control means pivotably mounted on the shaft and operatively connected to the ratchet for selective movement to a first position which moves the fell of the fabric to a location forwardly of the reed's beat-up position and to a second position to effect return of the fell to its initial position;

(b) means operatively associated with said control means for guiding the latter during its movement between said first and second positions; and (c) stop means attached to said guiding means forming a neutral and said first and second positions for said control means.

2. The apparatus according to claim 1 wherein said control means defines a double armed lever including:

(a) a control handle pivotably attached to one arm thereof; and (b) a control pawl pivotably attached to the other arm of said lever and extending from the latter into operative engagement with the ratchet.

3. The apparatus according to claim 2 wherein said guiding means defines a bracket member mounted on the loom with an elongated opening extending transversely of the axes of the shaft and ratchet and through which said control handle extends.

4. The apparatus according to claim 2 wherein said stop means define a selectively positionable pin member for each said first, second and neutral positions.

5. The apparatus according to claim 2 wherein the pin member for said neutral position is of lesser length than those for said first and second positions.

6. The apparatus according to claim 5 wherein said control handle is spring biased in the direction of the pin member defining said neutral position.

* * * * *